US006374545B1

(12) United States Patent
Baczuk

(10) Patent No.: US 6,374,545 B1
(45) Date of Patent: Apr. 23, 2002

(54) SNAP-ON DOOR SWEEP

(75) Inventor: Eric A. Baczuk, Kannapolis, NC (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/562,957

(22) Filed: May 3, 2000

(51) Int. Cl.[7] ..... E06B 1/70; E06B 7/22
(52) U.S. Cl. ..... 49/470; 49/492.1; 49/490.1
(58) Field of Search ..... 49/470, 467, 492.1, 49/495.1, 498.1, 475.1, 490.1

(56) References Cited

U.S. PATENT DOCUMENTS

| | | | | |
|---|---|---|---|---|
| 1,192,361 A | | 7/1916 | Wistrom | |
| 2,123,403 A | | 7/1938 | Connelly | |
| 2,293,292 A | | 8/1942 | Goellner | |
| 2,511,808 A | | 6/1950 | Petri | |
| 2,568,477 A | | 9/1951 | Westlund | |
| 2,686,943 A | | 8/1954 | Kunkel | |
| 2,934,802 A | | 5/1960 | Shekter | |
| 2,949,651 A | * | 8/1960 | Hill | 49/493.1 |
| 3,024,504 A | * | 3/1962 | Miller | 49/489.1 |
| 3,378,958 A | * | 4/1968 | Parks et al. | 49/489.1 |
| 3,382,613 A | | 5/1968 | Koller | |
| 3,448,543 A | | 6/1969 | Multer | |
| 3,690,037 A | * | 9/1972 | Kempel | 49/495.1 X |
| 3,854,246 A | | 12/1974 | McAllister | |
| 3,855,733 A | | 12/1974 | Miller | |
| 3,885,351 A | | 5/1975 | Imperial et al. | |
| 3,987,588 A | | 10/1976 | Imperial et al. | |
| 4,001,974 A | | 1/1977 | Wright | |
| 4,006,562 A | | 2/1977 | Belanger et al. | |
| 4,015,368 A | | 4/1977 | Court et al. | |
| 4,034,511 A | | 7/1977 | Bursk | |
| 4,080,756 A | | 3/1978 | Heaney | |
| 4,114,319 A | * | 9/1978 | Governale | 49/489.1 |
| 4,119,325 A | | 10/1978 | Oakley et al. | |
| 4,310,991 A | | 1/1982 | Seeley | |
| 4,656,785 A | | 4/1987 | Yackiw | |
| 4,712,331 A | | 12/1987 | Fujiwara | |
| 4,850,144 A | | 7/1989 | Grisham et al. | |
| 5,056,263 A | | 10/1991 | Bies | |
| 5,117,587 A | | 6/1992 | Doan | |
| 5,174,065 A | | 12/1992 | Schlicht | |
| 5,214,880 A | * | 6/1993 | Woodruff et al. | 49/490.1 |
| 5,475,948 A | | 12/1995 | Parke | |
| 5,528,863 A | | 6/1996 | Scott | |

* cited by examiner

*Primary Examiner*—Gregory J. Strimbu
(74) *Attorney, Agent, or Firm*—Pillsbury Winthrop LLP

(57) ABSTRACT

A door assembly includes a door and a snap-on door sweep. The door sweep is attached to the door in an operative position with a gripping engagement to provide a seal between a bottom door surface and a door opening. The door sweep includes a pair of groove engaging portions fixed to longitudinally opposing sides of a bottom wall portion of the door sweep and extending inwardly in spaced relation thereto. One of the pair of groove engaging portions constitutes a resilient snap-on portion having a cam portion thereon. The pair of groove engaging portions are operatively engaged in horizontally extending grooves in the door when the door sweep is in the operative position thereof. The cam portion includes a cam surface extending outwardly as it extends upwardly relative to the door and engages the door at a position below one of the horizontally extending grooves so that the cam portion deflects outwardly as it is forced upwardly and rides along the door in the position below one of the horizontally extending grooves until the door sweep reaches the operative position thereof with a snap action in which the snap-on portion moves inwardly by virtue of the resiliency thereof and the cam portion fixed thereon is disposed within one of the horizontally extending grooves.

13 Claims, 8 Drawing Sheets

SNAP-ON DOOR SWEEP

FIELD OF THE INVENTION

The present invention relates to door assemblies and more particularly to door assemblies including a door and a weather-sealing type component attached to the bottom portion of the door thereof.

BACKGROUND OF THE INVENTION

Typical weather-sealing type components herein contemplated, referred to hereafter as door sweeps, comprise a fastening structure to be attached to the bottom portion of the door and a sealing structure deformably engaging with a door opening threshold to provide the weather seal. Many of these door sweeps are secured to the bottom portion of the door by fasteners or adhesives which can damage the door and make replacement difficult.

The U.S. Pat. No. 5,056,263 discloses a door sweep secured without the use of fasteners or adhesives by installing the sweep from the end of the door by sliding rigid flanges on the sides of the sweep fastening structure through channels found in each side of the bottom portion of the door and pushing the component thereon. Manufacturing variations and tolerances in the commercial '263 door sweeps made this installation procedure difficult.

The '263 door sweep fastening structure comprises a transverse wall with vertical side walls on each side and opposed inwardly extending rigid flanges attached at the upper ends of the side walls. Each of the flanges has a tapered ramp surface at one end and a notch on the opposite end with the ramp surface and notch disposed in reverse relation in the two flanges. The sealing members of the sealing structure are constructed and arranged such that the door sweep will provide desirable sealing action in only one door opening direction. The sweep must be reversed if the direction is changed. The bottom portion of the door comprises horizontal channels in opposite sides thereof with each channel having a ramp portion at one end disposed in reverse relation in the two channels. In assembling the sweep to the door, the flanges are engaged with the channels and the ramp surface slides along the ramp portion of the channels which will cause the flanges and side walls to flex outwardly as the sweep is pushed on. The ramp portion abruptly returns to channel depth creating a point contact with which the flange and side walls flex outwardly therefrom. Once the other end of the sweep with the notch clears the ramp portion, flanges and side walls resiliently flex back inwardly positively locating the sweep at each end. The ramping portion of the door channels and the ramping surface and notch of the sweep were used only to lock the sweep in place at each end and keep it from moving in either direction. The sweep is fitted within the door channels without a gripping-type engagement.

Due to variations in the door sweep's extrusion process and the tolerance stack-ups in the door sweep and door channels, the installation process became difficult. An undersize door sweep matched with an oversize door required too great a force to slide the sweep on as the flanges and side walls were flexed outwardly. It was easy to start the ramp surface of the sweep out on the ramp portion, but as the ramp portion increased in size so did the force required to push it along. The rigid flanges and side walls being flexed outwardly from a point on the end of the ramp portion created too much friction to overcome manually. It caused customers to modify the door sweeps and doors often defeating the sealing properties in order to assemble them. The door sweeps are hammered on and sometimes they cannot be installed at all. If it is desired to remove the sweep to replace after wear or to accommodate an opposite swing direction of the door, pliers were needed to grip one flange and flex it back to clear the ramp and then forcefully pull it out. There is a need for a door sweep that facilitates the installation and replacement process allowing for similar manufacturing variations and tolerances as in the '263 commercial door sweep so as to not affect the overall cost.

SUMMARY OF THE INVENTION

It is an object of the present invention to meet the above-described need. In accordance with the principles of the present invention, this objective is achieved by providing a door assembly comprising a door including horizontal grooves formed in opposing sides thereof in upwardly spaced relation with respect to a bottom door surface. A snap-on door sweep is constructed and arranged to be attached to the door in an operative position with a gripping engagement to provide a seal between the bottom door surface and a door opening threshold when the door is disposed in a closed position within a door opening. The snap-on door sweep is constructed and arranged to be manually moved from an initial position into the operative position with a snap action.

The snap-on door sweep includes a rigid attaching structure constructed and arranged to be attached to the door in cooperating relation to the horizontal grooves and the bottom surface thereof when the snap-on door sweep is in the operative position with respect thereto. The snap-on door sweep also includes a flexible threshold engaging seal assembly carried by the rigid attaching structure in a position so as to extend downwardly therefrom when the snap-on door sweep is in the operative position thereof.

The rigid attaching structure includes an elongated bottom wall portion constructed and arranged to be operatively disposed below the bottom surface of the door when the snap-on door sweep is in the operative position thereof. The rigid attaching structure also includes a pair of groove engaging portions fixed to widthwise opposing sides of the bottom wall portion and extending inwardly in spaced relation thereto. One of the pair of groove engaging portions constitutes a snap-on portion having a cam portion fixed thereto. The pair of engaging portions are constructed and arranged to be operatively engaged in the horizontal grooves when the snap-on door sweep is in the operative position thereof to grippingly retain the snap-on door sweep therein.

The snap-on door sweep is constructed and arranged to be manually moved into the initial position thereof wherein the cam portion is engaged with the door adjacent the bottom door surface and one widthwise side thereof in generally lengthwise coextensive relation therewith. The cam portion includes a cam surface configured and positioned such that when the snap-on door sweep is moved from the initial position thereof into the operative position thereof the cam surface engages the door and moves the snap-on portion outwardly and allows the snap-on portion to move into the operative position thereof with the snap action as the snap-on door sweep reaches the operative position thereof.

Preferably, the seal assembly comprises a first and second elongated side sealing structure on opposing sides of the bottom wall portion. The first and second sealing structures are constructed and arranged to enable the door to be installed within the door opening so as to move from an inside position into the closed position wherein the first sealing structure is swept across the door threshold in sealing relation between the door bottom surface and the door threshold. The first and second sealing structures are also constructed and arranged to enable the door to be installed within the door opening so as to move from an outside position into the closed position wherein the second sealing structure is swept across the door threshold in sealing relation between the door bottom surface and the door threshold.

Preferably, the seal assembly also includes a water deflecting element disposed outwardly of the first sealing structure and extending downwardly in diverging relation with respect to the first sealing structure for an extent not greater than the downward extent of the first sealing structure when the snap-on door sweep is in the operative position thereof.

The objective can also be achieved by providing a door sweep assembly for use with a door including horizontal grooves formed in opposing sides thereof in upwardly spaced relation with respect to a bottom door surface. The door sweep assembly comprises a snap-on door sweep including all the features described above.

These and other objects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF THE INVENTION

Figure 1:
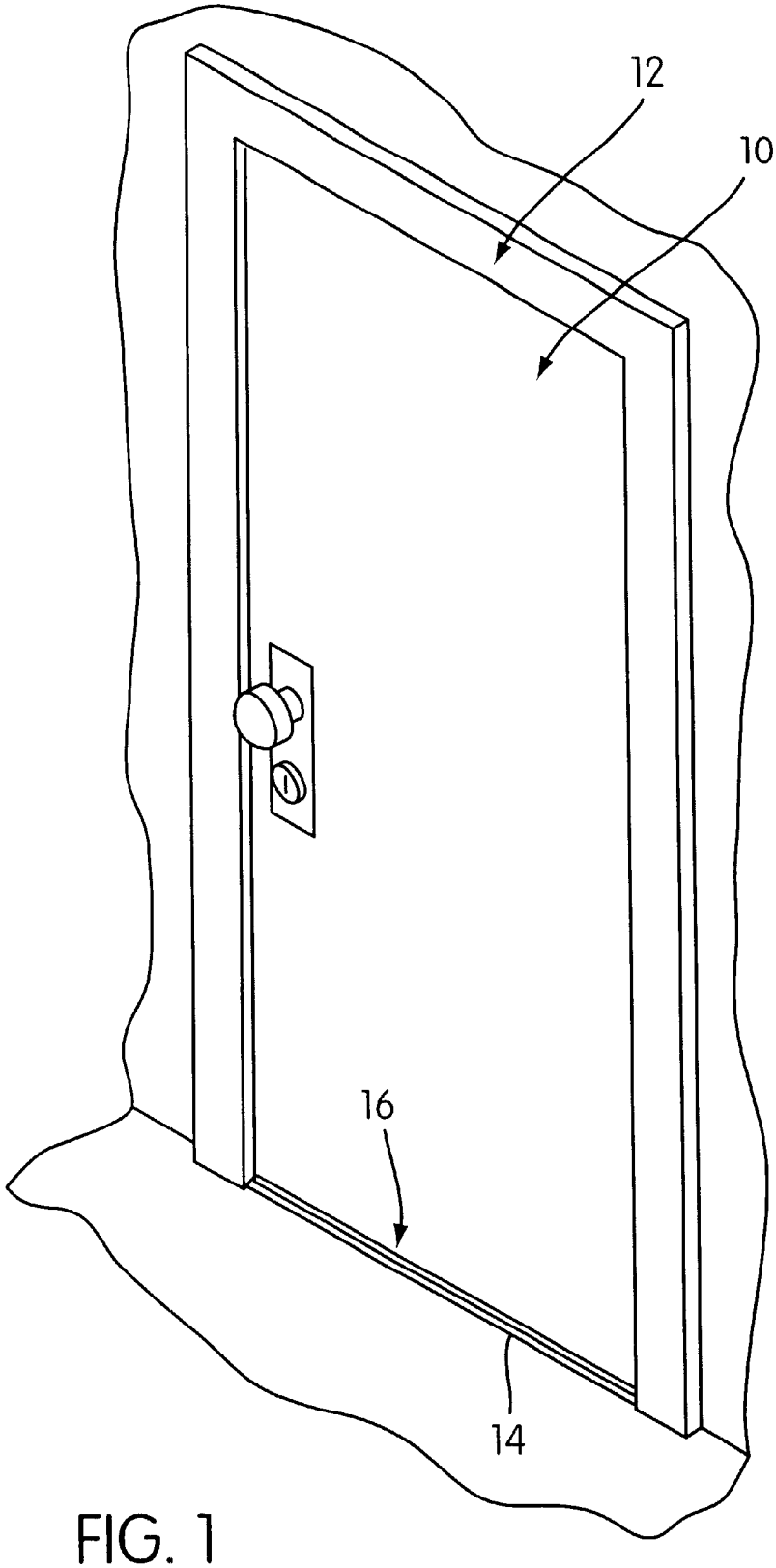
FIG. 1 is a fragmentary perspective view of a door assembly constructed in accordance with the principles of the present invention.

FIG. 1 shows a door assembly which embodies the principles of the present invention. The door assembly comprises a door, shown generally at 10, pivotally mounted within a door frame, shown generally at 12, a door opening threshold 14, and a snap-on door sweep, shown generally at 16.

Figure 2:
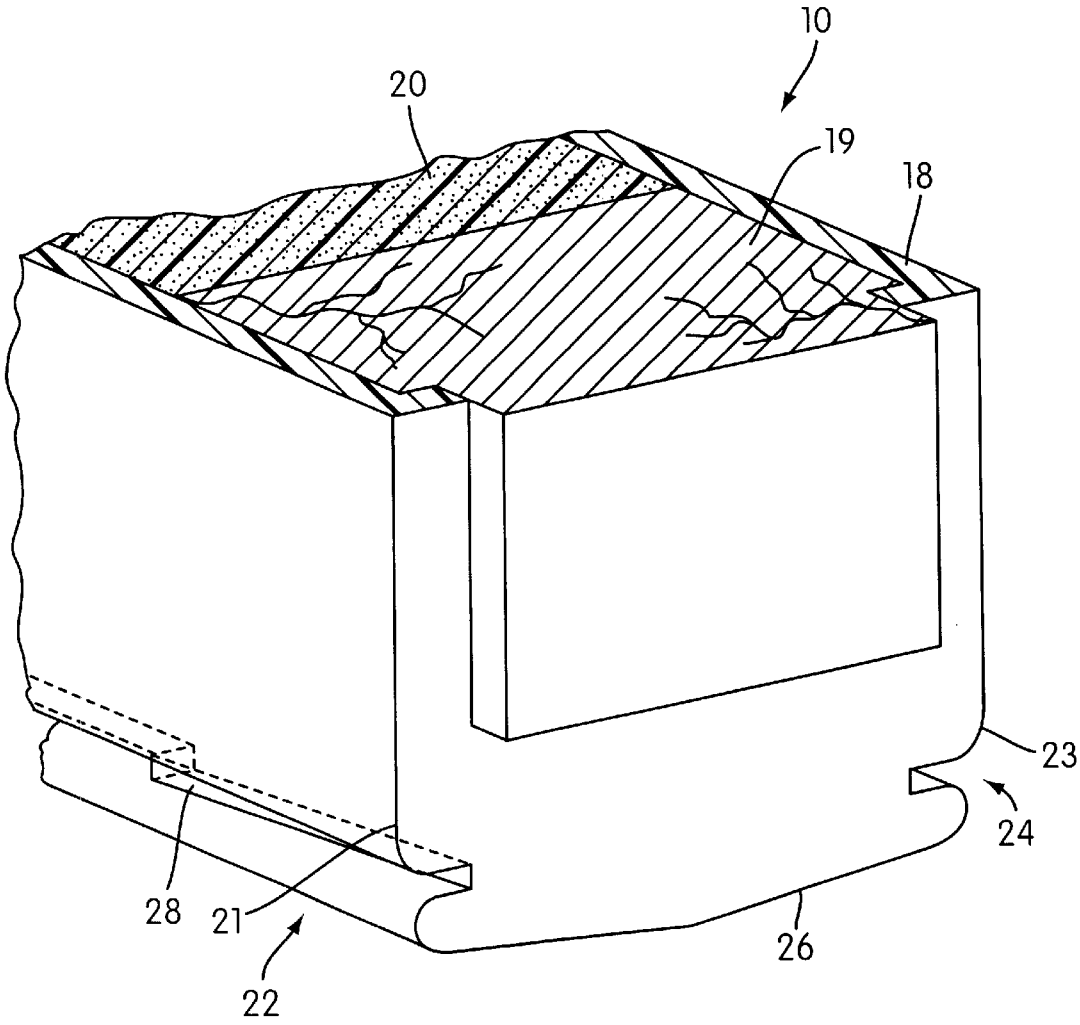
FIG. 2 is a fragmentary perspective view of a bottom portion of a door constructed in accordance with the principles of the present invention.

FIG. 2 shows a fragmentary bottom portion of one end of the door 10. The door 10 generally comprises an outer skin 18, an inner core 20, and a vertical member 19 along each end of the door 10. The door 10 includes horizontal grooves, shown generally at 22, 24, formed in opposing sides 21, 23 thereof in upwardly spaced relation with respect to a bottom door surface 26. As shown, each of the grooves 22, 24 has a ramp portion 28 at one end thereof disposed in reverse relation that provides a horizontal shoulder when the grooves 22, 24 return to normal depth.

The snap-on door sweep 16 is constructed and arranged to be attached to the door 10 with a gripping engagement to provide a seal between the bottom door surface 26 and the door opening threshold 14 when the door 10 is disposed in a closed position within the door opening as in FIG. 1.

Figure 3:
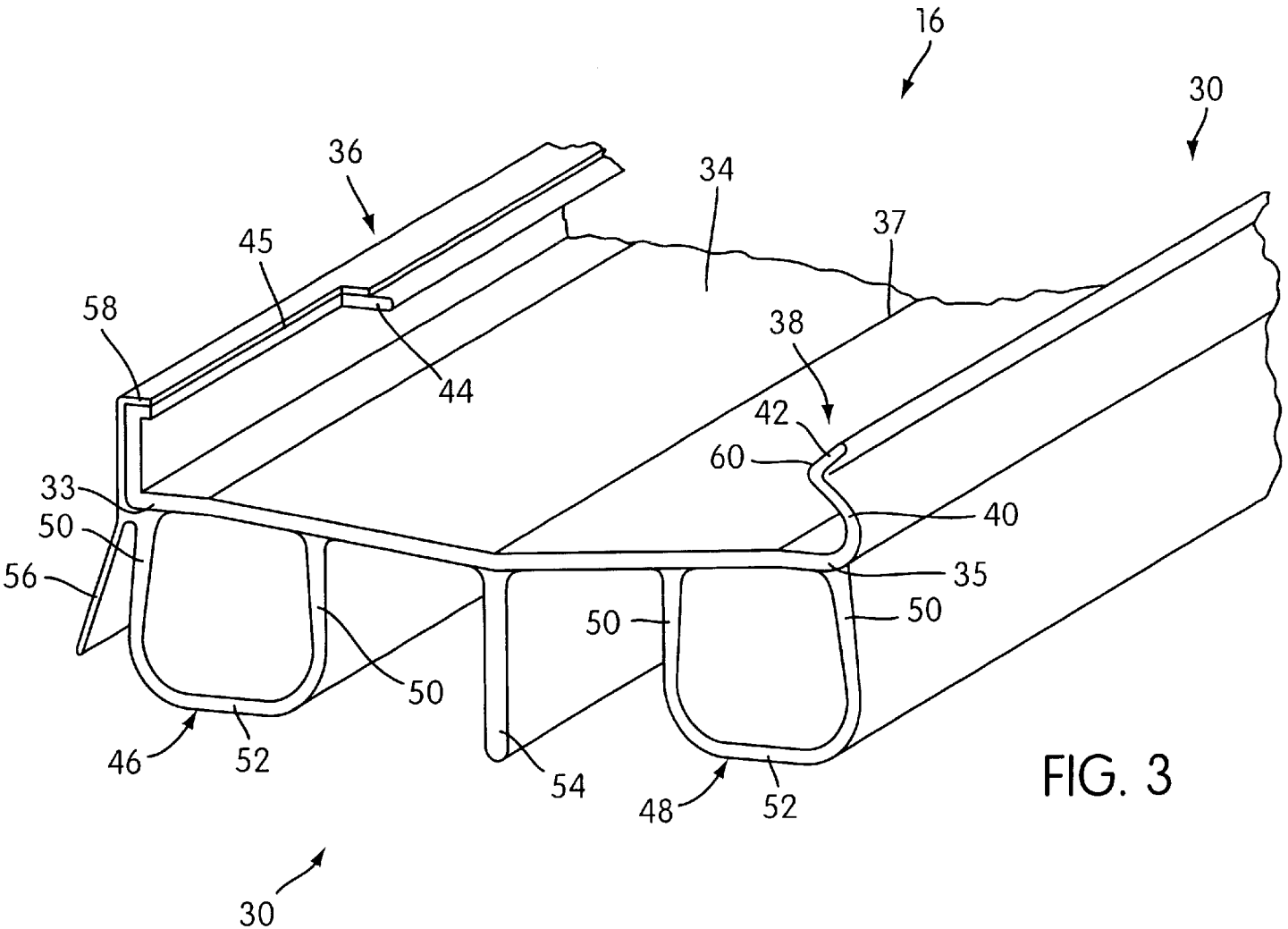
FIG. 3 is a fragmentary perspective view of a snap-on door sweep constructed in accordance with the principles of the present invention.
Figure 4:
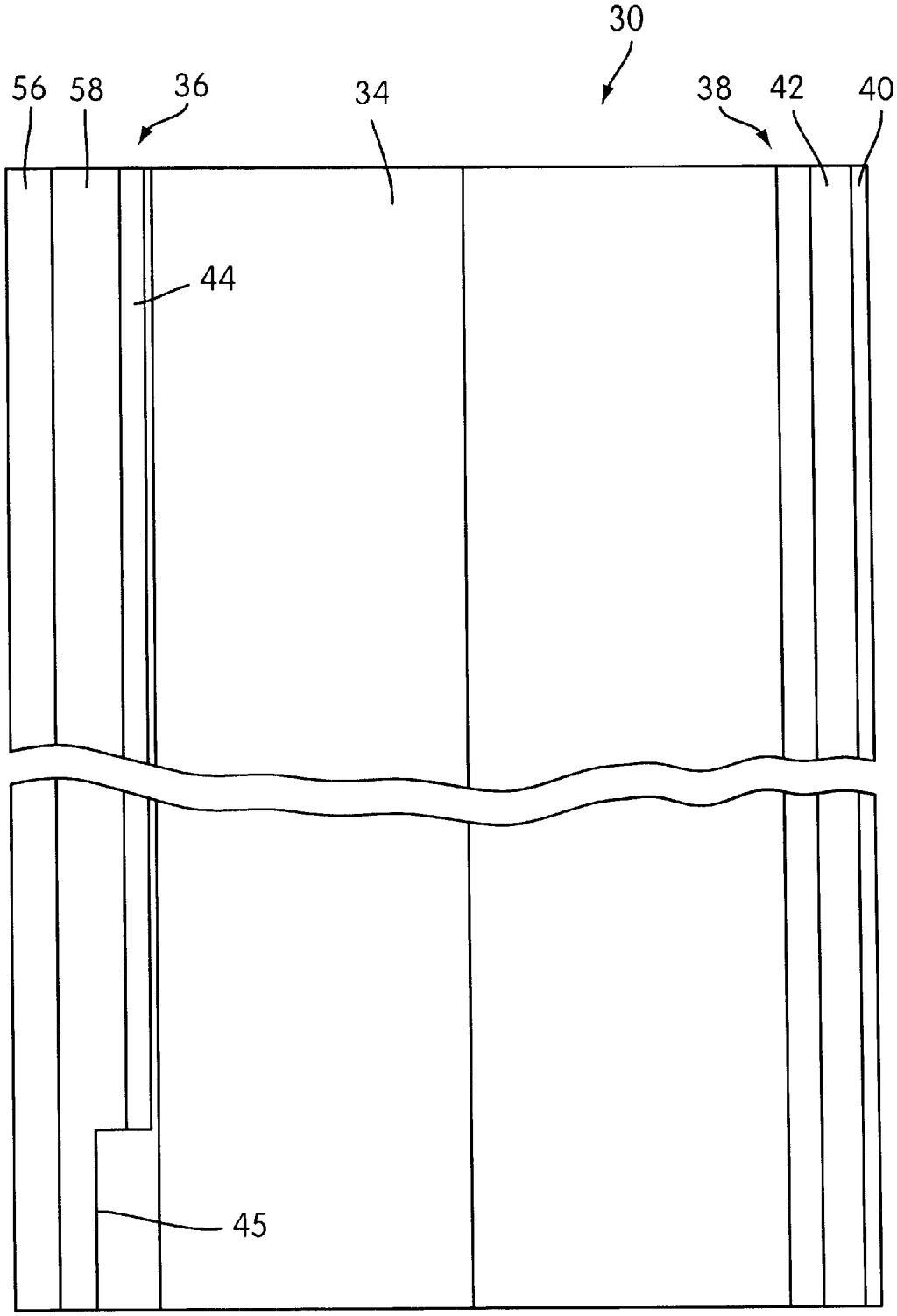
FIG. 4 is a fragmentary top view of the snap-on door sweep.
Figure 5:
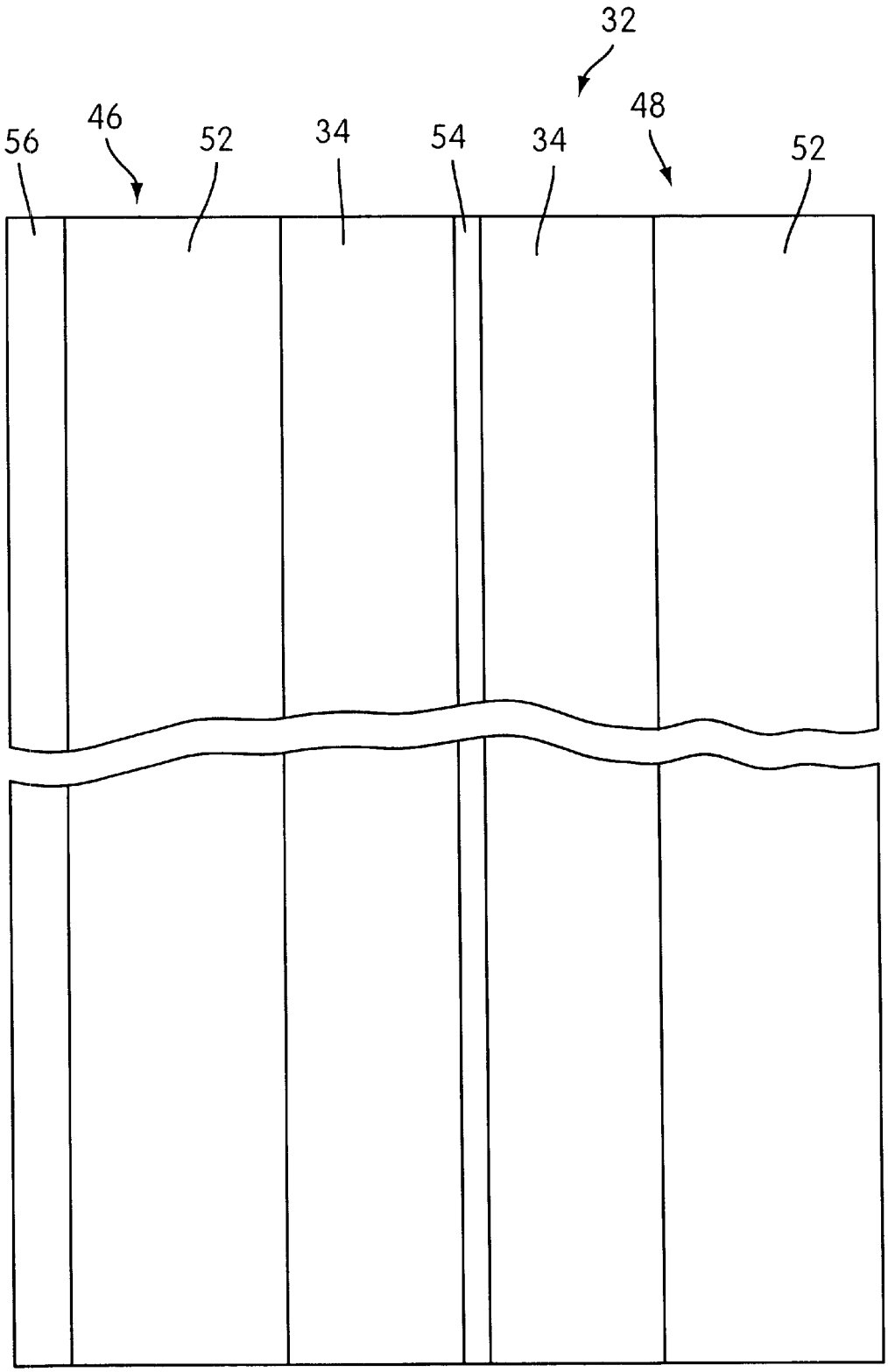
FIG. 5 is a fragmentary bottom view of the snap-on door sweep.

FIG. 3 shows the snap-on door sweep 16 which includes a relatively rigid attaching structure, shown generally at 30, and a relatively flexible threshold engaging seal assembly, shown generally at 32.

The attaching structure 30 includes an elongated bottom wall portion 34 which angles slightly downwardly from widthwise opposing sides 33, 35 to a central portion 37 thereof. A pair of groove engaging portions, shown generally at 36, 38, are fixed to respective opposing sides 33, 35 of the bottom wall portion 34 and extend inwardly in spaced relation thereto. The groove engaging portion 38 constitutes a snap-on portion 40 having a cam portion 42 fixed thereto. The groove engaging portion 36 constitutes an insertion portion 44. A notch 45 is cut out of the engaging portion 36 at one end of the sweep 16.

The seal assembly 32 comprises a first and second elongated sealing structures, shown generally at 46, 48, on opposing sides 33, 35 of the bottom wall portion 34. Each of the first and second sealing structures 46, 48 are generally U-shaped in cross-sectional configuration. Each of the U-shaped first and second sealing structures 46, 48 have legs 50 fixed to the bottom wall portion 34 and a bight portion 52 extending between the legs 50. A vertically extending wiper wall element 54 has one end fixed to the central portion 37 of the bottom wall portion 34. A water deflecting element 56 disposed outwardly of the first sealing structure 46 extends downwardly in diverging relation with respect to the first sealing structure 46. The downward extent of the element 56 is not greater than the downward extent of the first sealing structure 46. The seal assembly 32 further includes a sealing layer 58 conforming to an outer surface of the groove engaging portion 36.

Figure 6:
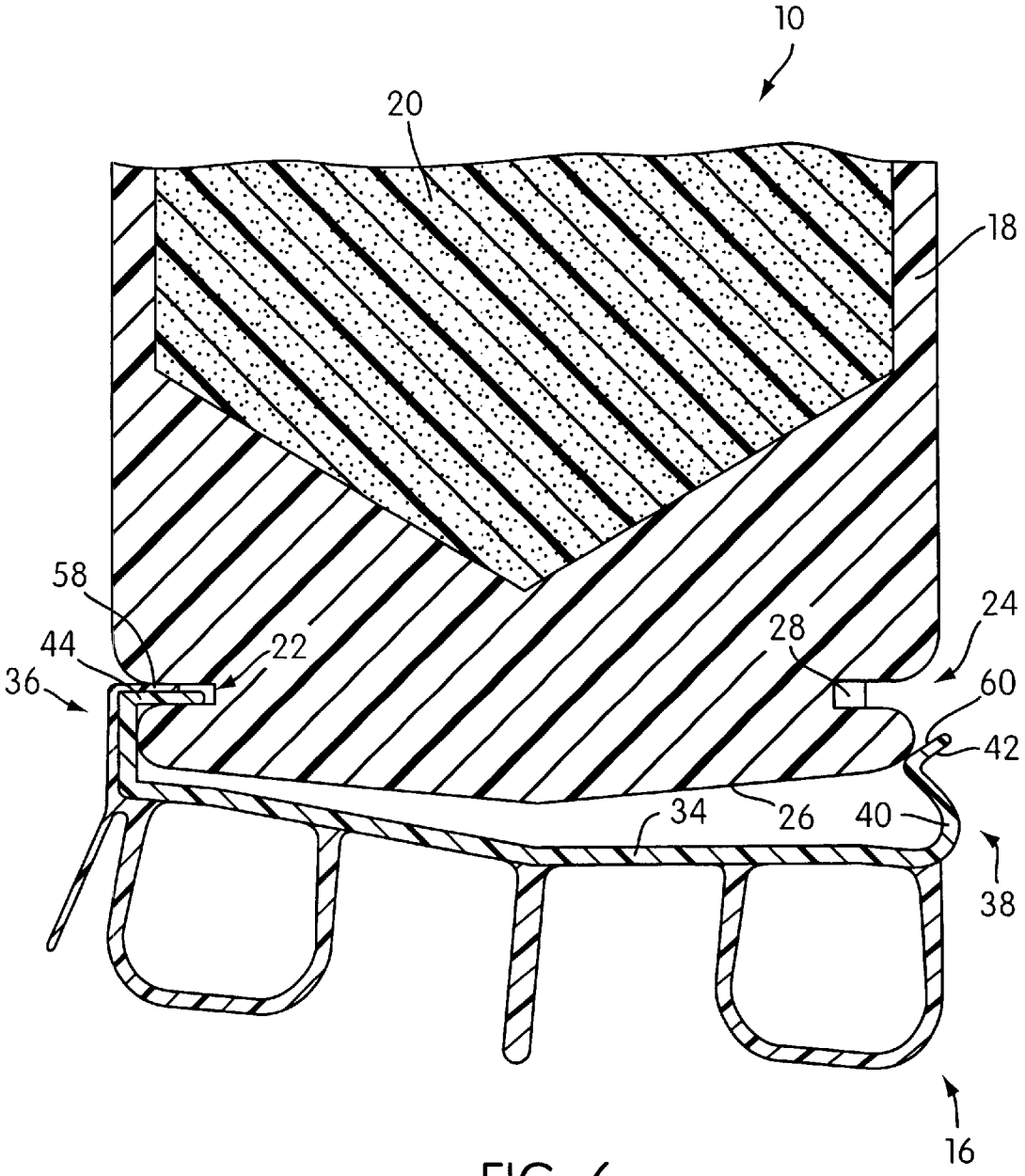
FIG. 6 is a cross-sectional view of the initial position of the snap-on door sweep when assembling the door.
Figure 7:
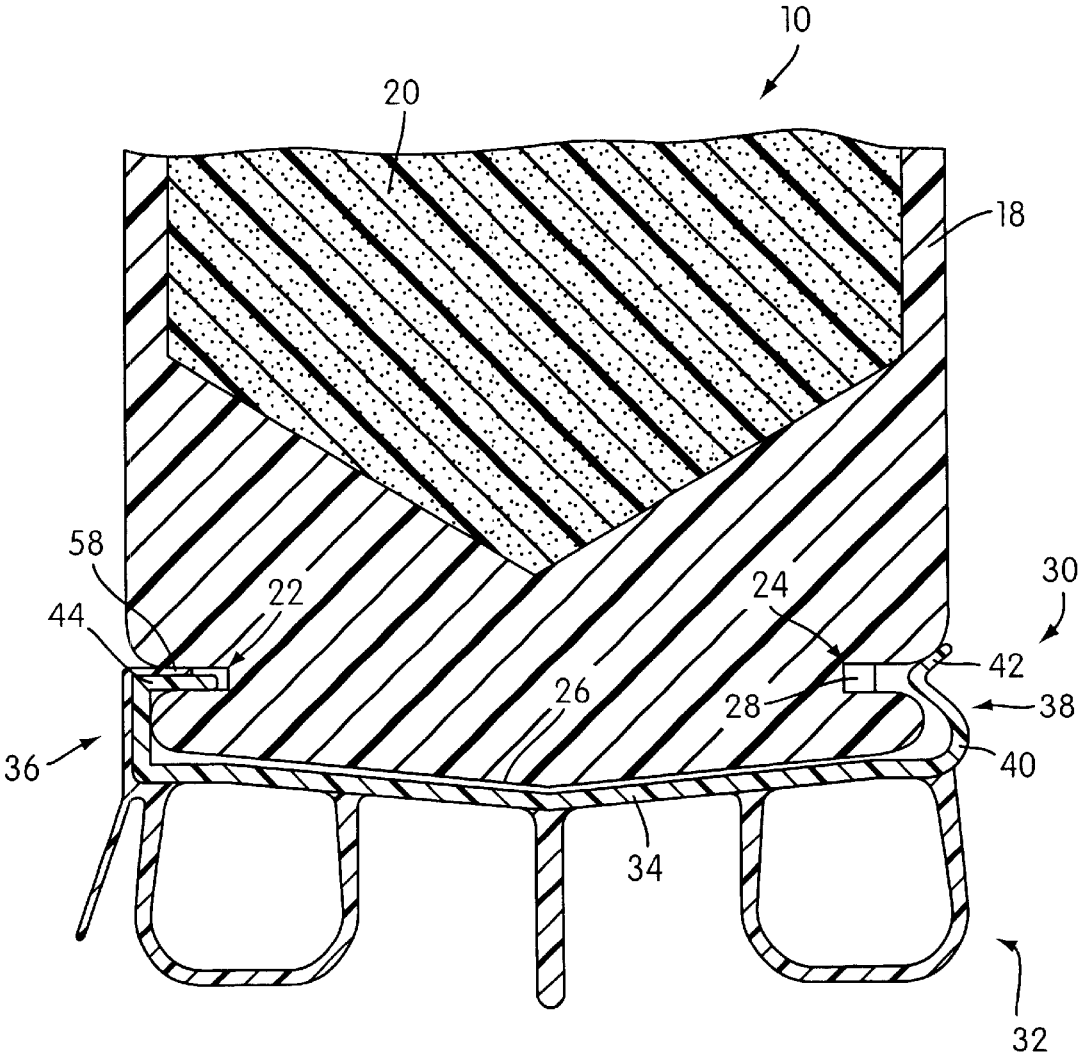
FIG. 7 is a cross-sectional view of the operative position of the snap-on door sweep when assembled to the door.

In assembling the sweep 16 to the door 10, the sweep 16 is constructed and arranged to be manually moved from an initial position shown in FIG. 6 into an operative position shown in FIG. 7 with a snap action.

The sweep 16 is manually moved into the initial position (FIG. 6) thereof wherein the insertion portion 44 is engaged in the horizontal groove 22 and the cam portion 42 is engaged with the door adjacent the bottom door surface 26 and one widthwise side thereof is in generally coextensive relation therewith. The cam portion 42 includes a cam surface 60 configured and positioned such that when the sweep 16 is moved from the initial position thereof into the operative position thereof, the cam surface 60 engages the door 10 and moves the snap-on portion 40 outwardly and allows the snap-on portion 40 to move into the operative position thereof with the snap action as the sweep 16 reaches the operative position thereof.

When the sweep 16 is in the operative position (FIG. 7), the attaching structure 30 is attached to the door 10 in a cooperating relation to the horizontal grooves 22, 24 and the bottom door surface 26 thereof. The bottom wall portion 34 is disposed below the bottom door surface 26 and conforms to the angle of the bottom door surface 26. The engaging portions 36, 38 are operatively engaged in the horizontal grooves 22, 24 to grippingly retain the same therein with the cam portion 42 entirely disposed within the horizontal groove 24. The seal assembly 32 carried by the attaching structure 30 extends downwardly therefrom with the sealing layer 58 providing a water-sealing fit within the horizontal groove 22.

Figure 8:
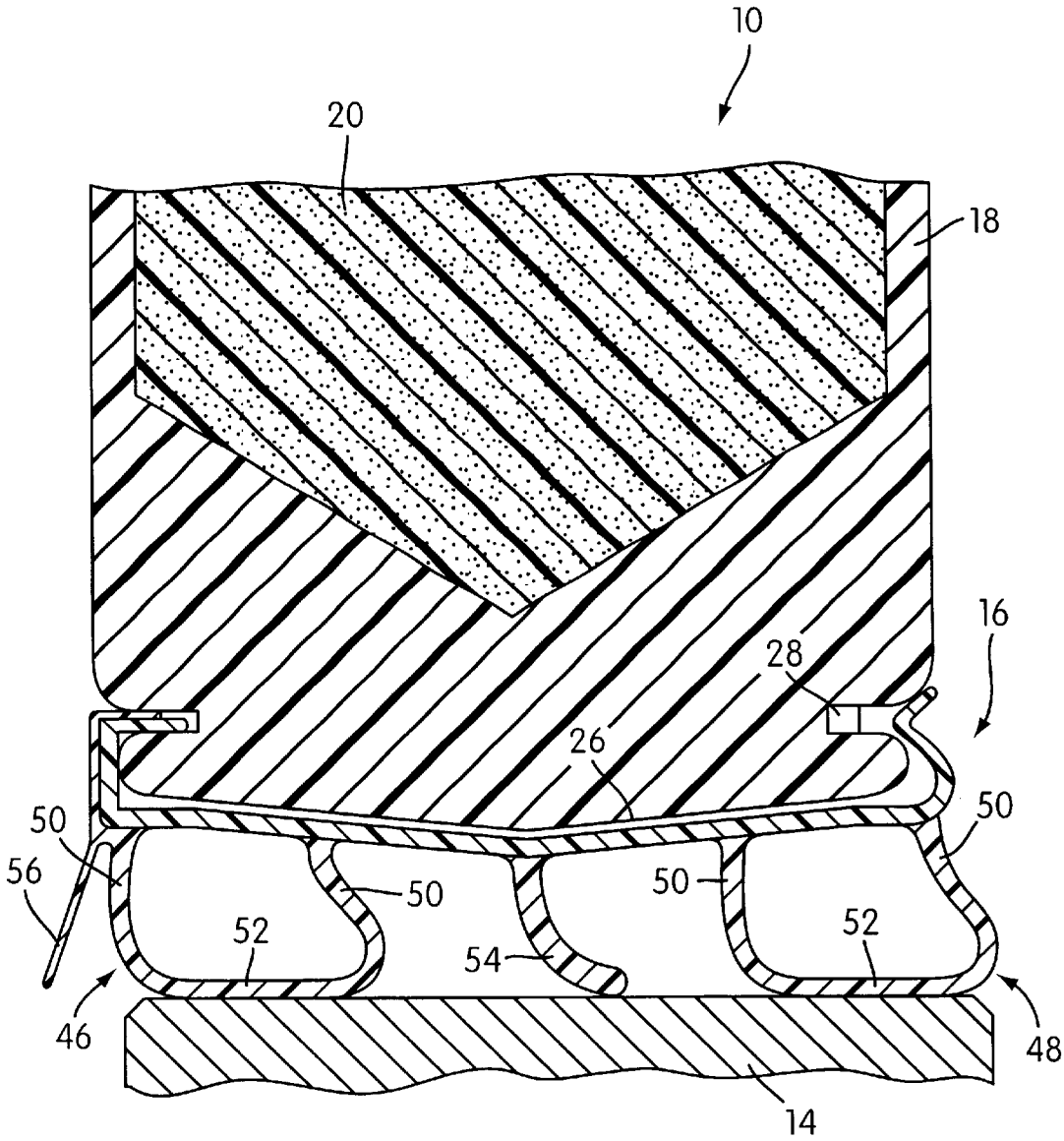
FIG. 8 is a fragmentary cross-sectional view of the sealing relationship of a door opening threshold and the snap-on door sweep when in the operative position and the door is disposed in a closed position.

The sealing assembly 32 is constructed and arranged to enable a sealing relation regardless of the swing direction of the door. The first and second sealing structures 46, 48 enable the door 10 to be installed within the door opening so as to move from an inside position into the closed position wherein the first sealing structure 46 is swept across the door opening threshold 14 in sealing relation between the bottom door surface 26 and the door opening threshold 14 or move from an outside position into the closed position wherein the second sealing structure 48 is swept across the door opening threshold 14 in sealing relation between the bottom door surface 26 and the door opening threshold 14. During the closing, the bight portion 52, legs 50, and wiper wall element 54 are deformed when engaging the threshold 14 to provide a weather tight seal. FIG. 8 shows the sealing relationship of the sweep 16, the threshold 14, and the door 10 when the door is disposed in the closed position within the door opening.

The snap-on door sweep 16 is constructed as a coextrusion that adheres the relatively rigid attaching structure 30 made from rigid polyvinylchloride, or also referred to as rigid PVC, and the relatively flexible threshold engaging seal assembly 32 made from flexible polyvinylchloride, or also referred to as flexible PVC, together. Each material has the necessary degree of resiliency to attain a high life and perform a desirable attaching and sealing action.

The notch 45 in the engaging portion 36 is cut out to clear the ramp portion 28 of the groove 22. The engaging portion 38 with the snap-on portion 40 engages the groove 24 in such a manner that it clears the ramp portion 28 making a notch on the snap-on portion 40 unnecessary. Although the horizontal shoulder created by the ramp portion 28 can help to locate the insertion portion 44 within the groove 22, it serves no other functional purpose. It is not needed to hold the sweep 16 in place as the sweep 16 grippingly engages the grooves 22, 24. The ramp portions 28 were needed for the '263 patent described in the background to hold it in place and the same door was used so as to make manufacturing a new door unnecessary. Preferably, the ramp portions 28 are simply not provided.

While the above-described sweep and installation process is preferred in the broadest aspects, the present invention contemplates the use of another snapon portion in place of the insertion portion. The modified sweep can be installed the same as above by inserting one of the snap-on portions in a groove for the initial position and moving the sweep into the operative position with a snap action. The modified sweep could also be installed by positioning both cam portions of the snap-on portions into engagement with the door adjacent the bottom door surface and respective side thereof in generally coextensive relation therewith and then moving the entire sweep into the operative position with a snap action of each side.

The sealing assembly 32 described above enabling a sealing relation regardless of the swing direction of the door 10 could be used with any other known attaching structures including the attaching structure of the '263 patent described in the background.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A door assembly comprising:

a door including two horizontally extending grooves each formed in a respective one of a pair of opposing exterior sides of the door in an upwardly spaced relation with respect to a bottom door surface;

a snap-on door sweep constructed and arranged to be attached to said door in an operative position with a gripping engagement to provide a seal between the bottom door surface and a door opening threshold when said door is disposed in a closed position within a door opening;

said snap-on door sweep including:

(1) a rigid attaching structure constructed and arranged to be attached to said door in cooperating relation to said horizontally extending grooves and said bottom door surface when said snap-on door sweep is in the operative position with respect thereto, and (2) a flexible threshold engaging seal assembly carried by said rigid attaching structure in a position so as to extend downwardly therefrom when said snap-on door sweep is in said operative position;

said rigid attaching structure including:

an elongated bottom wall portion constructed and arranged to be operatively disposed below said bottom door surface when said snap-on door sweep is in the operative position, and a pair of groove engaging portions fixed to a pair of opposing sides of said bottom wall portion and extending inwardly in spaced relation thereto;

one of said pair of groove engaging portions constituting a resilient snap-on portion having a cam portion thereon;

said pair of groove engaging portions being constructed and arranged to be operatively engaged in said horizontally extending grooves when said snap-on door sweep is in said operative position to grippingly retain said snap-on door sweep on said door;

said snap-on door sweep being constructed and arranged to be oriented such that said cam portion is engaged with said door at a position below one of said horizontally extending grooves;

said cam portion including a cam surface extending outwardly as it extends upwardly relative to the door when said snap-on door sweep is in said operative position, said cam surface constructed and arranged to engage said door at said position below one of said horizontally extending grooves so that said cam portion deflects outwardly as it is forced upwardly with respect to said door and rides along said door in said position below one of said horizontally extending grooves until said snap-on door sweep reaches the operative position.

2. A door assembly as defined in claim 1 wherein said seal assembly comprises:

a first and second elongated sealing structures disposed on said bottom wall portion, said first and second sealing structures being constructed and arranged to be swept across the door threshold in a sealing relation between said bottom door surface and said door threshold;

said seal assembly also including a water deflecting element disposed outwardly of said first sealing structure and extending downwardly in diverging relation with respect to said first sealing structure for an extent not greater than a downward extent of said first sealing structure when said snap-on door sweep is in the operative position.

3. A door assembly as defined in claim 2 wherein another of said pair of groove engaging portions constitutes an insertion portion which is configured to be inserted within the other one of said horizontally extending grooves.

4. A door assembly as defined in claim 3 wherein said cam portion is entirely disposed within said one of said horizontally extending grooves when said snap-on door sweep is in the operative position.

5. A door assembly as defined in claim 4 wherein said seal assembly further includes a sealing layer conforming to an outer surface of said insertion portion and providing a water-sealing fit within said other one of said horizontally extending grooves when said snap-on door sweep is in the operative position.

6. A door assembly as defined in claim 5 wherein each of said first and second sealing structures have a generally U-shaped cross-sectional configuration, each of said U-shaped first and second sealing structures having legs fixed to said bottom wall portion and a bight portion extending between said legs, said bight portions configured and positioned to engage the door opening threshold when said door is disposed in the closed position;

said seal assembly further including a vertically extending wiper wall element having one end fixed to a central portion of said bottom wall portion and an other end for engaging the door opening threshold when said door is disposed in the closed position.

7. A door assembly as defined in claim 6 wherein said bottom wall portion angles slightly downwardly from each of said opposing sides thereof to the central portion thereof.

8. A door assembly as defined in claim 7 wherein said rigid attaching structure is made from rigid PVC and said flexible threshold engaging seal assembly is made from flexible PVC.

9. A door assembly as defined in claim 8 wherein said snap-on door sweep is constructed as a coextrusion that adheres said rigid attaching structure and said flexible threshold engaging seal assembly together.

10. A door assembly as defined in claim 1 wherein said rigid attaching structure is made from rigid PVC and said flexible threshold engaging seal assembly is made from flexible PVC.

11. A door assembly as defined in claim 1 wherein said snap-on door sweep is constructed as a coextrusion that adheres said rigid attaching structure and said flexible threshold engaging seal assembly together.

12. A door assembly as defined in claim 1 wherein said bottom wall portion angles slightly downwardly from each of said opposing sides thereof to a central portion thereof.

13. A door assembly as defined in claim 1 wherein said cam portion is entirely disposed within said one of said horizontally extending grooves when said snap-on door sweep is in the operative position.

* * * * *